US007245295B2

(12) United States Patent
Chen et al.

(10) Patent No.: US 7,245,295 B2
(45) Date of Patent: Jul. 17, 2007

(54) DEVICE AND METHOD OF DYNAMIC DRIVING FOR LIQUID CRYSTAL DISPLAY

(75) Inventors: Cheng-Jung Chen, Chu-Nan County (TW); Jhih-Hong Jiang, Su-Ao County (TW)

(73) Assignee: Vastview Technology Inc., Hsinchu (TW)

( * ) Notice: Subject to any disclaimer, the term of this patent is extended or adjusted under 35 U.S.C. 154(b) by 590 days.

(21) Appl. No.: 10/772,930

(22) Filed: Feb. 4, 2004

(65) Prior Publication Data

US 2005/0168433 A1 Aug. 4, 2005

(51) Int. Cl.
*G09G 1/06* (2006.01)

(52) U.S. Cl. ..... 345/204; 345/87; 345/90; 345/94; 345/95; 345/210; 345/501

(58) Field of Classification Search ..... 345/87, 345/94, 95, 101, 204, 208, 210, 213, 690
See application file for complete search history.

(56) References Cited

U.S. PATENT DOCUMENTS

| | | | | |
|---|---|---|---|---|
| 4,516,055 | A * | 5/1985 | Nelson | 315/151 |
| 5,694,493 | A * | 12/1997 | Tuli | 382/270 |
| 5,926,162 | A * | 7/1999 | Wood et al. | 345/101 |
| 6,304,236 | B1 * | 10/2001 | Arai et al. | 345/10 |
| 2002/0149577 | A1 * | 10/2002 | Arai et al. | 345/204 |
| 2003/0098839 | A1 | 5/2003 | Lee | 345/89 |
| 2003/0107546 | A1 | 6/2003 | Ham | 345/101 |

* cited by examiner

*Primary Examiner*—Bipin Shalwala
*Assistant Examiner*—Vincent E. Kovalick

(57) ABSTRACT

A dynamic driving device is disclosed. The device enhances the display effect of a dynamic image on a liquid crystal display by dynamically adjusting the driving voltage applied to a liquid crystal display's Graphic Processing Unit (GPU) or Central Processing Unit (CPU). The device utilizes a driving path selection unit to allow a user to specify a driving path through an operation interface, which in turn affects the variation of driving voltage applied on the Graphic Processing Unit by dynamically adjusting the drive to the liquid crystal display.

14 Claims, 5 Drawing Sheets

DEVICE AND METHOD OF DYNAMIC DRIVING FOR LIQUID CRYSTAL DISPLAY

FIELD OF THE INVENTION

The present invention is related to a dynamic driving method, and more particularly to a method that can dynamically adjust the drive voltage applied to a liquid crystal display in accordance with the surrounding atmospheric environment.

BACKGROUND OF THE INVENTION

Liquid crystal display (LCD) has gradually replaced cathode ray tube (CRT) display in recent years due to its characteristics such as smaller size and lighter weight. However, factors affecting the display effect of liquid crystal display, such as grey-scale response speed, are highly related to the surrounding atmospheric environment of the display, such as temperature. To achieve higher quality of display from liquid crystal display, therefore, the user's surrounding environment should be taken into consideration as well. In general, under the identical driving method, the grey-scale response time of a liquid crystal display increases one millisecond when the ambient temperature of the liquid crystal display decreases one degree.

FIG. 1 of the attached drawings is a pictorial representation of the original driving paths. As shown in FIG. 1, the original driving path refers to the driving voltage's variation from its initial driving voltage to the targeted driving voltage under a certain temperature, such as T1 or T2. The original driving path under temperature T1 reaches the targeted driving voltage at a time t1. Since temperature T1 is much higher than T2, the original driving path under temperature T2 reaches the targeted driving voltage at a time t2 that is later than t1. Because of this, the same liquid crystal display could easily be affected by its surrounding atmospheric environment (especially temperature) to have different grey-scale imaging speed and in turn result in significant difference in dynamic image display effect under temperature T1 and T2.

Based on the foregoing description, it should not be difficult to understand that the display effect of a liquid crystal display is closely related to the surrounding atmospheric environment of the liquid crystal display. When driving the liquid crystal of a liquid crystal display, it is therefore required to take into consideration as a factor the surrounding atmospheric environment of the liquid crystal display.

Currently in the industry, LG Philips adopts a technique to take surrounding atmospheric environment factor into consideration as described in Document No. U.S.2003/0107546, titled "Method and Apparatus for Driving Liquid Crystal Display", published on Jun. 12, 2003. The '546 patent basically utilizes a temperature sensor to detect the ambient temperature of a liquid crystal display, obtaining an appropriate correction from a pre-established Look Up Table (LUT) based on the sensed temperature, and then applying the correction to the output signal of dynamic images.

Samsung adopts another technique to take surrounding atmospheric environment factor into consideration as described in Document No. U.S.2003/0098839, titled "Liquid Crystal Display and a Driving Method Thereof", published on May 29, 2003. The '839 patent applies correction to the dynamic images' output signal based on correcting parameters derived from temperature, user-determined image quality, and the display related surrounding environment.

The above two industry solutions both require the use of temperature sensors to obtain the ambient temperature of a liquid crystal display before correcting the output of dynamic images. However, both solutions not only require additional cost from the temperature sensors, but also lose flexibility by over-emphasizing the temperature variation. After all, the display effect of a liquid crystal display is not entirely related to temperature variation.

SUMMARY OF THE INVENTION

The present invention provides a dynamic driving device and method, without knowing the ambient temperature of a liquid crystal display, which dynamically adjusts a drive applied to the liquid crystal display to enhance the display effect of dynamic images.

To achieve the goals set forth, a dynamic driving device is disclosed, comprising a driving path selection unit. The driving path selection unit allows a user to specify the most appropriate driving path through an operation interface. The dynamic driving device then follows the selected driving path to dynamically adjust the driving voltage applied to a Graphic Processing Unit of a liquid crystal display.

The benefit and essence of the present invention will become more obvious from the following description when taken in connection with the accompanying drawings, which show, for purposes of illustration only, preferred embodiments in accordance with the present invention.

DETAILED DESCRIPTION OF THE INVENTION

Figure 1:
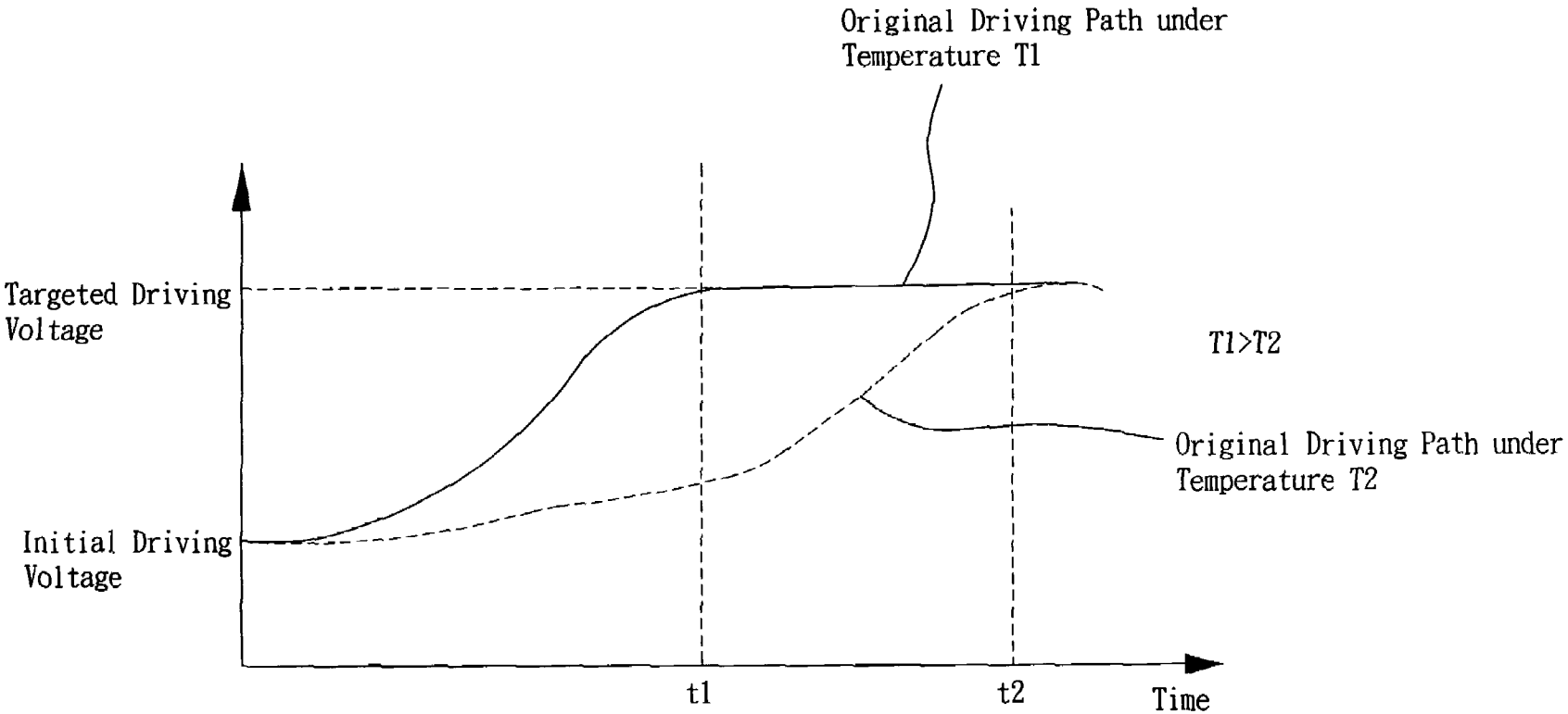
FIG. 1 is a pictorial representation of the original driving paths.
Figure 2:
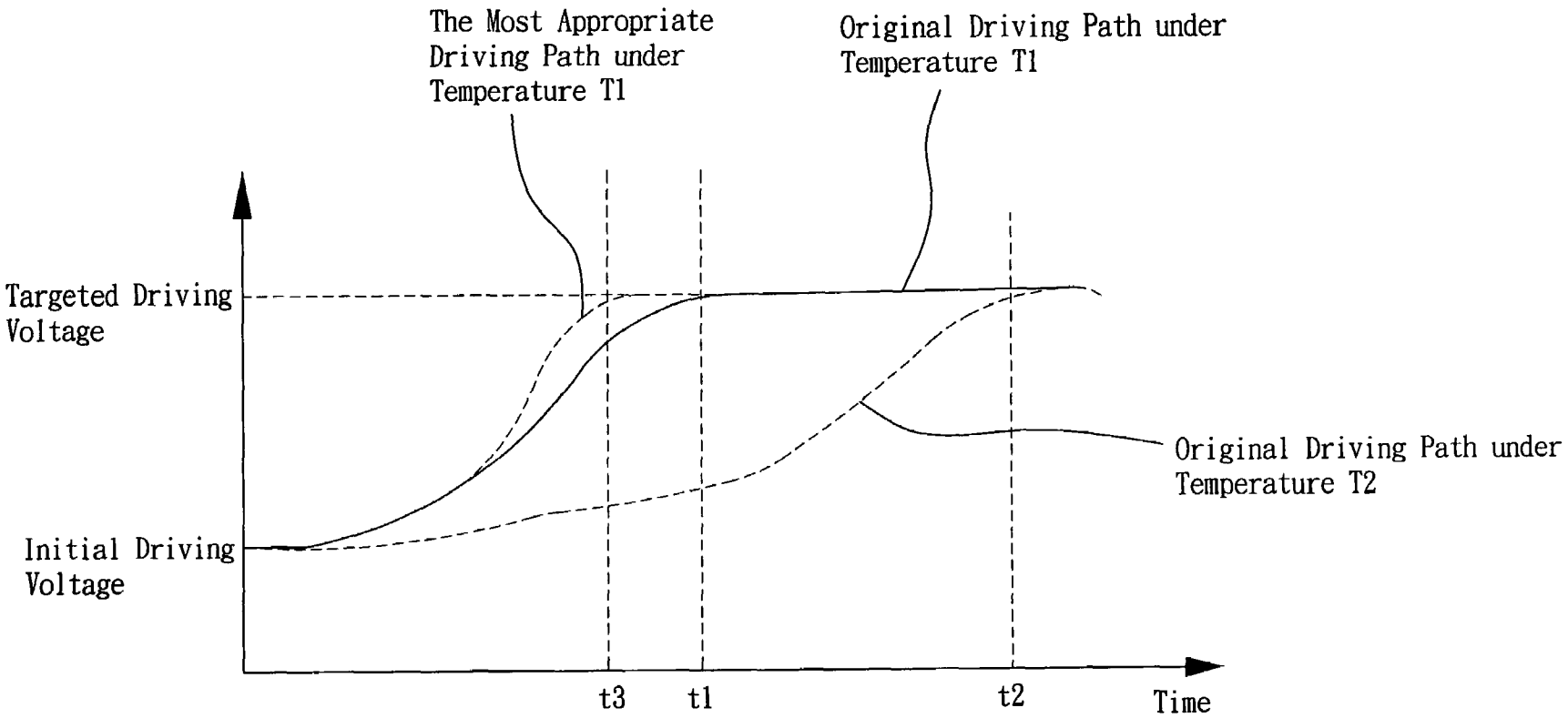
FIG. 2 is a pictorial representation of the most appropriate driving path achieved by the present invention.

With reference to the drawings and in particular to FIG. 2, a most appropriate driving path under temperature T1 is achieved by dynamically adjusting the drive to alter temperature T1's original driving path. The purpose of such dynamic adjustment lies in that, under the same temperature T1, the most appropriate driving path reaches the targeted driving voltage at a time t3 that is earlier than the time t1 required by the original driving path. Identically, if a liquid crystal display's ambient temperature is T2, the present invention will apply dynamic adjustment so that the targeted driving voltage will be reached also at the same time t3 under temperature T2.

Even though the achievement of the most appropriate driving path described by the present invention is mainly a result closely related to the temperature in the surrounding atmospheric environment, it would not be flexible enough if simply the user is asked to specify or by other means to obtain the ambient temperature or other surrounding atmospheric environmental conditions. The present invention, therefore, utilizes an operation interface that presents the dynamic images before and after applying the driving path generated by the dynamic adjusting driving method for the user's comparison. Based on the dynamic images before and after adjustment (there could be two or more images), the user can specify the most appropriate driving path. The device and method disclosed in the present invention, therefore, not only require no prior knowledge of the surrounding atmospheric conditions of a liquid crystal display, but also can locate the most appropriate driving path to enhance dynamic image display effect after interaction with the user. It should be specifically noted here that the so-called most appropriate driving path is one that is determined from the interaction between the user and the device disclosed in the present invention. Detailed description will be given below to explain the two methods disclosed by the present invention to determine the most appropriate driving path by dynamically adjusting the drive.

Figure 3:
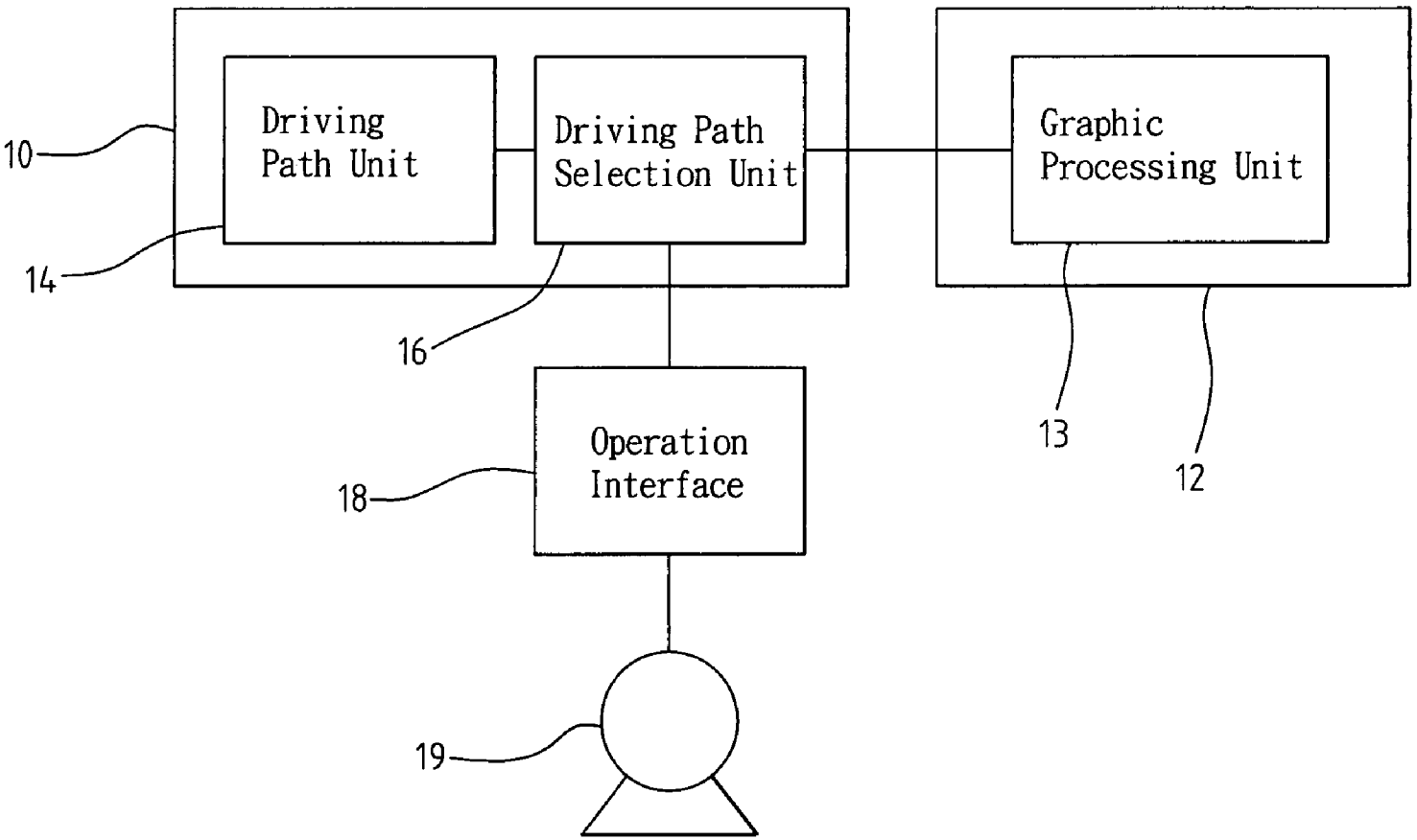
FIG. 3 shows the content of the dynamic driving device of the present invention and a liquid crystal display driven by the device.

Also referring to FIG. 3, the dynamic driving device 10 of the present invention enhances the display effect of dynamic images on the liquid crystal display 12 by dynamically adjusting the driving voltage applied to the Graphic Processing Unit (GPU) 13 or Central Processing Unit (CPU) in the liquid crystal display 12. The dynamic driving device 10 further contains a driving path selection unit 16. A user 19, based on the information presented to him through the operation interface 18, uses one of the dynamic adjusting driving methods to specify the most appropriate driving path to the driving path selection unit 16, which in turn influences the driving voltage variation applied to the Graphic Processing Unit 13. The driving path unit 14 is used to store a plurality of pre-defined driving paths. Further description will be given below to describe the relationship between the two dynamic adjusting driving methods and the information provided by the operation interface 18.

Figure 4:
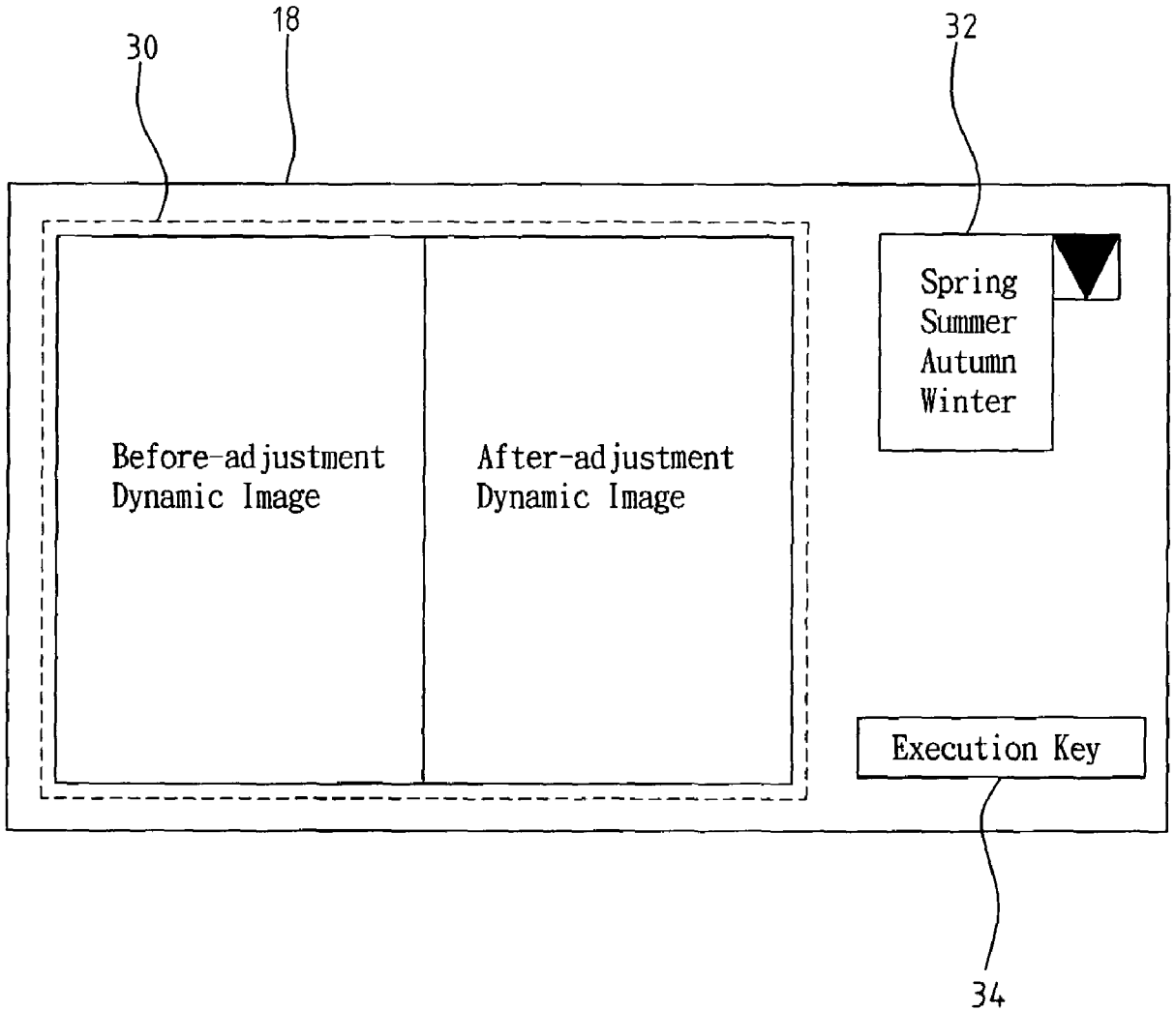
FIG. 4 shows the first method to dynamically adjust the driving device in the present invention.

Also referring to FIG. 4, the operation interface outlined in FIG. 3 further consists of a drive adjustment area 32, a dynamic image test area 30, and an execution key 34. The spring, summer, autumn, and winter driving paths contained in the drive adjustment area 32 are obtained from the driving path unit 14 as outlined in FIG. 3. Hence, the drive adjustment area allows a user 19 depicted in FIG. 3 to issue adjustment command and select one of the spring, summer, autumn, and winter driving paths. The foregoing driving paths are defined by the driving path decision process. The said driving path decision process pre-defines a plurality of driving paths corresponding to the surrounding atmospheric environment based on the surrounding atmospheric environment of spring, summer, autumn, and winter. The dynamic image test area contains dynamic images before and after adjustment. Among them, the after-adjustment dynamic image is displayed by applying the driving path selected by the user 19. The two dynamic images embody the major information provided by the operation interface 18. After the user 19 determines the most appropriate driving path based on the dynamic images before and after adjustment, the execution key 34 is used to set the most appropriate driving path as system default so that, before the next adjustment, liquid crystal display 12 will continue to use the selected, most appropriate driving path.

Assuming the current season of user 19 is autumn (that is, temperature T1), the dynamic image before adjustment is generated by the original driving path under temperature T1 as shown in FIG. 2. If the user 19, for example, issues adjustment command by selecting the summer driving path in the drive adjustment area 32 on the operation interface 18, the after-adjustment dynamic image is generated by the Summer driving path. Because the current season of user 19 is autumn, the selection of summer driving path by user 19 is not appropriate. Hence, user 19 can observe from the dynamic image test area 30 that the after-adjustment dynamic image generated by the summer driving path is not better, or even worse, than the before-adjustment dynamic image. To find a better driving path, user 19 again issues adjustment command by selecting the autumn driving path in the drive adjustment area 32. This time, due to the selection of an appropriate driving path, the dynamic image test area 30 can be observed to see that, after comparing the after-adjustment dynamic image generated by the autumn driving path and the before-adjustment dynamic image, the display effect is obviously better. In other words, the autumn driving path is the most appropriate driving path under temperature T1 as shown in FIG. 2. The user 19 then sets the most appropriate driving path as the default driving path that the liquid crystal display 12 will begin to use from now on. In the following, before introducing another dynamic adjusting driving method, how the driving paths stored in the driving path unit 14 are determined by the driving path decision process will be explained.

The driving path decision process of the present invention is conducted as follows. First, the variation in image parametric value, such as pixels' brightness value in a time-related frame of the dynamic images played on liquid crystal display 12 is measured. The liquid crystal display's driving path relative to the ambient temperature can then be derived. In other words, by simulating the surrounding atmospheric environment of a liquid crystal display to be spring, summer, autumn, and winter, the original driving paths corresponding to autumn (temperature T1), winter (temperature T2), and so on, can be determined.

After obtaining the original driving paths corresponding to a number of preset surrounding atmospheric environments, new driving paths that can enhance the display effect of dynamic images on a liquid crystal display under the atmospheric environments are re-calculated and generated from the original driving paths. In other words, the result of re-calculation can lead to the most appropriate driving path in the season autumn (under temperature T1) as depicted in FIG. 2. It should be specifically noted that, as the weather of different geographical regions might be different in the same season, driving paths aiming for various regions' four seasons could be pre-defined and stored in driving path unit 14.

Figure 5:
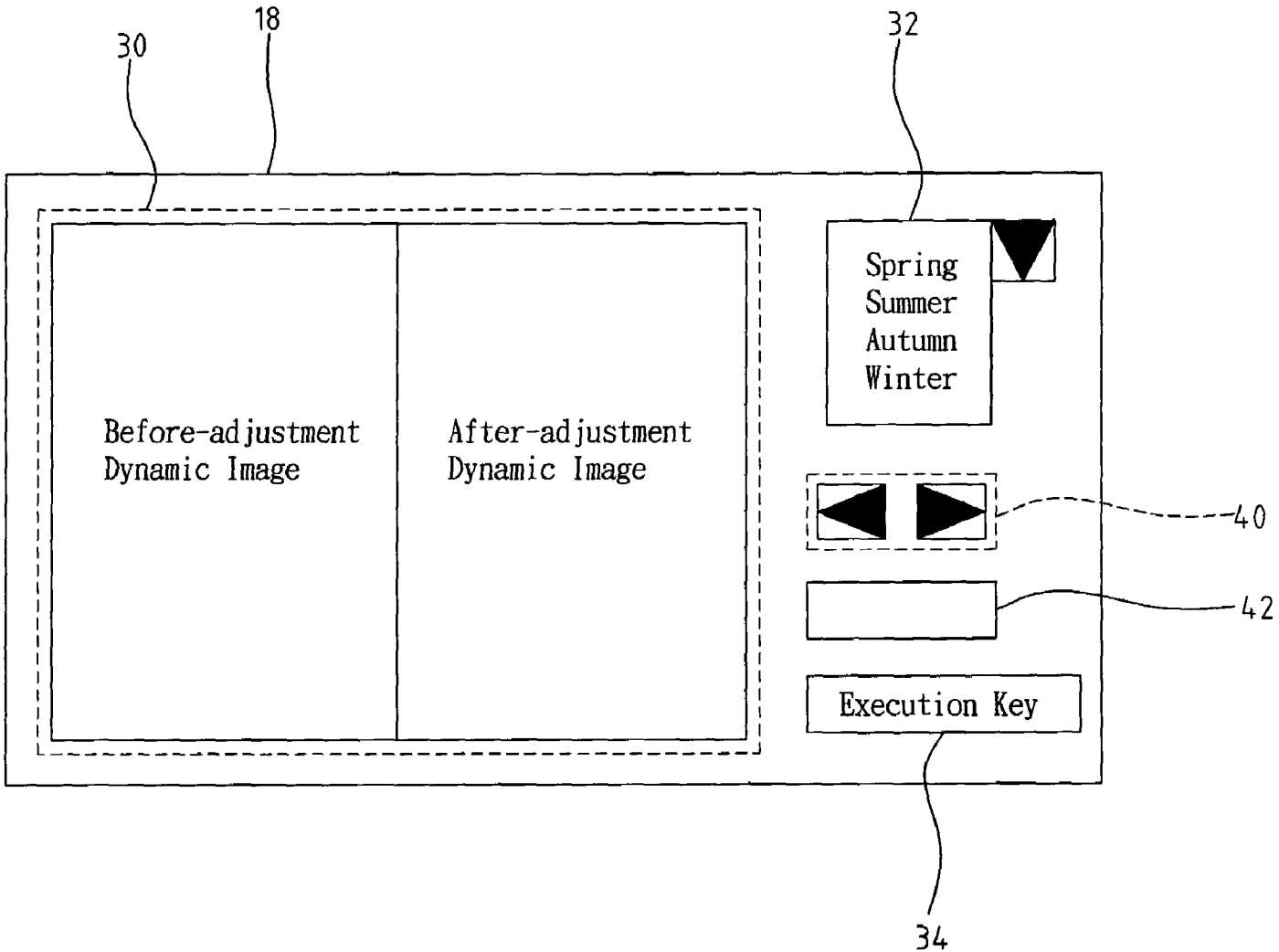
FIG. 5 shows the second method to dynamically adjust the driving device in the present invention.

Also referring to FIG. 5, the second dynamic adjusting driving method has additional drive adjustment area 40 and 42 as compared to the first dynamic adjusting driving method depicted in FIG. 4. The first and second dynamic adjusting driving methods differ in that a user 19 utilizes different drive adjustment areas to issue adjustment commands. However, no matter how adjustment commands are issued, a new driving path will be generated accordingly and the after-adjustment dynamic image will be displayed in the dynamic image test area 30 based on the newly generated driving path. The possibilities of combining the use of drive adjustment area 32, 40, and 42, and how drive adjustment area 40 and 42 affect the after-adjustment dynamic image will be described below.

As shown in FIG. 5, the drive adjustment area 32 is not required to be present on the operation interface 18 at the same time with drive adjustment area 40 and 42. Drive adjustment areas 40 and 42 can both affect the generated driving path. That is, they can both affect how the after-adjustment dynamic image is displayed. Of course, drive adjustment area 40 and 42 can also be present on the operation interface 18 by themselves without jointly affecting the generated driving path and the display of the after-adjustment dynamic image. In this way, they deliver the adjustment result independently.

The greatest difference between the first and the second dynamic adjusting driving method lies in how the adjustment command is issued. In the first method, a plurality of driving paths corresponding to various surrounding atmospheric environment are pre-defined and stored in the driving path unit 14. The user then issues adjustment commands by selecting a driving path in the drive adjustment area 32 on the operation interface 18. In the second method, the user issues adjustment commands by increasing or decreasing the parametric value through the drive adjustment area 40 or directly enter a parametric value in the drive adjustment area 42 on the operation interface 18.

In addition, drive adjustment area 40 can be used together with drive adjustment area 32 in that drive adjustment area 40 can influence the driving path selected by the drive adjustment area 32. In other words, drive adjustment area 40 can provide micro-adjustment to the driving path selected by the drive adjustment area 32 in order to obtain the perfect driving path.

Combining what is described above, the present invention provides a dynamic driving device, through the two above disclosed dynamic adjusting driving methods or a combination of them, to dynamically adjust the drive to the liquid crystal display, which enhances its display effect of dynamic images. Compared to the technologies disclosed by the '546 and '839 Patents, the present invention does not require the use of temperature sensors. Instead, the present invention allows the user to specify the most appropriate driving path by providing the before- and after-adjustment dynamic images in the dynamic image test area 30. Hence the dynamic driving device and methods disclosed in the present invention have considered not only the influence from temperature, but also any other factors that can affect the display effect of a liquid crystal display.

The foregoing detailed description of the preferred implementation details are given in the hope to more clearly disclose the characteristics and spirit of the present invention. The preferred implementation details are not intended to impose any constraint on the scope of the present invention. On the contrary, the purpose is to incorporate various changes and equivalent arrangements therein without departing from the spirit and scope of the present invention.

What is claimed is:

1. A dynamic driving device for enhancing display of a dynamic image by dynamically adjusting a driving voltage applied to a Graphic Processing Unit (GPU) of a liquid crystal display, comprising:

a driving path selection unit for allowing a user to specify a most appropriate driving path by dynamically adjusting a driving path through an operation interface, and further affecting voltage variation of said driving voltage applied to said Graphic Processing Unit; and a driving path unit used to store a plurality of pre-defined driving paths, said plurality of pre-defined driving paths being defined by a driving path decision process based on atmospheric environment to pre-define a plurality of driving paths corresponding to different atmospheric environment.

2. The dynamic driving device as claimed in claim 1, wherein said driving path decision process further comprising the following steps:

(1) measuring the difference of an image parametric value within a time-related frame of said dynamic image on said liquid crystal display, and then deriving said driving path on said liquid crystal display corresponding to surrounding atmospheric environment; and (2) re-calculating, based on said surrounding atmospheric environment, to obtain said driving path capable of enhancing said display effect of said dynamic image on said liquid crystal display corresponding to said surrounding atmospheric environment.

3. The dynamic driving device as claimed in claim 2, wherein said image parametric value is the brightness parametric value of pixels.

4. The dynamic driving device as claimed in claim 1, wherein said atmospheric environment is temperature.

5. The dynamic driving device as claimed in claim 1, wherein said operation interface further comprising:

a dynamic image test area, further comprising at least a before-adjustment dynamic image and an after-adjustment dynamic image, said before-adjustment dynamic image being based on an original driving path of said driving path before adjustment;

a drive adjustment area for allowing said user to issue adjustment command to select a driving path from a plurality of driving paths stored in said driving path unit, said after-adjustment dynamic image being based on the selected driving path generated by said adjustment command; and an execution key for setting the most appropriate driving path as a default driving path, said most appropriate driving path being determined by said user based on the comparison between said before-adjustment dynamic image and said after-adjustment dynamic image.

6. A dynamic driving device for enhancing display of a dynamic image by dynamically adjusting a driving voltage applied to a Graphic Processing Unit (GPU) of a liquid crystal display, comprising:

a driving path selection unit for allowing a user to specify a most appropriate driving path by dynamically adjusting a driving path through an operation interface, and further affecting voltage variation of said driving voltage applied to said Graphic Processing Unit;

wherein said driving path is a variation of driving voltage from an initial driving voltage to a targeted driving voltage.

7. A dynamic driving device for enhancing display of a dynamic image by dynamically adjusting a driving voltage applied to a Graphic Processing Unit (GPU) of a liquid crystal display, comprising:

a driving path selection unit for allowing a user to specify a most appropriate driving path by dynamically adjusting a driving path through an operation interface, and further affecting voltage variation of said driving voltage applied to said Graphic Processing Unit;

wherein said operation interface further comprising:

a dynamic image test area, further comprising at least a before-adjustment dynamic image and an after-adjustment dynamic image, said before-adjustment dynamic image being based on an original driving path of said driving path before adjustment;

a drive adjustment area for generating a new driving path based on an adjustment command issued by said user, said after-adjustment dynamic image being based on the new driving path generated by said adjustment command; and an execution key for setting the most appropriate driving path as a default driving path, said most appropriate driving path being determined by said user based on the comparison between said before-adjustment dynamic image and said after-adjustment dynamic image.

8. A dynamic driving method for enhancing display of a dynamic image by dynamically adjusting a driving voltage applied to a Graphic Processing Unit (GPU) of a liquid crystal display, comprising at least the following steps:

specifying a most appropriate driving path by dynamically adjusting how a driving path is exercised, and further affecting voltage variation of said driving voltage applied to said Graphic Processing Unit;

wherein said dynamic driving method further includes a plurality of pre-defined driving paths corresponding to and based on different atmospheric environment.

9. The dynamic driving method as claimed in claim 8, wherein said atmospheric environment is temperature.

10. The dynamic driving method as claimed in claim 8, wherein specifying said most appropriate driving path comprising:

(1) displaying a before-adjustment dynamic image based on an original driving path of said driving path;

(2) displaying an after-adjustment dynamic image by selecting a driving path from said plurality of pre-defined driving paths based on an adjustment command; and (3) setting said most appropriate driving path as a default driving path after determining said most appropriate driving path based on said before-adjustment dynamic image and said after-adjustment dynamic image.

11. A dynamic driving method for enhancing display of a dynamic image by dynamically adjusting a driving voltage applied to a Graphic Processing Unit (GPU) of a liquid crystal display, comprising at least the following steps:

specifying a most appropriate driving path by dynamically adjusting how a driving path is exercised, and further affecting voltage variation of said driving voltage applied to said Graphic Processing Unit;

wherein said driving path is a variation of driving voltage from an initial driving voltage to a target driving voltage.

12. A dynamic driving method for enhancing display of a dynamic image by dynamically adjusting a driving voltage applied to a Graphic Processing Unit (GPU) of a liquid crystal display, comprising at least the following steps:

specifying a most appropriate driving path by dynamically adjusting how a driving path is exercised, and further affecting voltage variation of said driving voltage applied to said Graphic Processing Unit;

wherein said driving path is defined by a driving path decision process comprising the following steps:

(1) measuring the difference of an image parametric value within a time-related frame of said dynamic image on said liquid crystal display, and then deriving said driving path on said liquid crystal display corresponding to surrounding atmospheric environment; and (2) re-calculating, based on said surrounding atmospheric environment, to obtain said driving path capable of enhancing the display effect of said dynamic image on said liquid crystal display corresponding to said surrounding atmospheric environment.

13. The dynamic driving method as claimed in claim 12, wherein said image parametric value is the brightness parametric value of pixels.

14. A dynamic driving method for enhancing display of a dynamic image by dynamically adjusting a driving voltage applied to a Graphic Processing Unit (GPU) of a liquid crystal display, comprising at least the following steps:

specifying a most appropriate driving path by dynamically adjusting how a driving path is exercised, and further affecting voltage variation of said driving voltage applied to said Graphic Processing Unit;

wherein specifying said most appropriate driving path comprising:

(1) displaying a before-adjustment dynamic image based on an original driving path of said driving path;

(2) displaying an after-adjustment dynamic image based on a new driving path generated by an adjustment command issued by a user; and (3) setting said most appropriate driving path as a default driving path of said driving path after determining said most appropriate driving path based on said before-adjustment dynamic image and said after-adjustment dynamic image.

* * * * *